US009281151B2

(12) United States Patent
Nguyen et al.

(10) Patent No.: US 9,281,151 B2
(45) Date of Patent: Mar. 8, 2016

(54) LEVER ARM FOR A SHUNT TRIP DEVICE

(71) Applicant: Siemens Industry, Inc., Alpharetta, GA (US)

(72) Inventors: Huy Nguyen, Suwanee, GA (US); Mauricio Rodriguez, Duluth, GA (US)

(73) Assignee: SIEMENS INDUSTRY, INC., Alpharetta, GA (US)

( * ) Notice: Subject to any disclaimer, the term of this patent is extended or adjusted under 35 U.S.C. 154(b) by 1 day.

(21) Appl. No.: 14/478,418

(22) Filed: Sep. 5, 2014

(65) Prior Publication Data

US 2015/0179381 A1 Jun. 25, 2015

Related U.S. Application Data

(60) Provisional application No. 61/918,251, filed on Dec. 19, 2013.

(51) Int. Cl.

| | |
|---|---|
| ***H01H 83/00*** | (2006.01) |
| ***H01H 73/02*** | (2006.01) |
| ***H01H 71/24*** | (2006.01) |
| ***H01H 71/02*** | (2006.01) |

(52) U.S. Cl.
CPC ..... *H01H 71/2463* (2013.01); *H01H 71/0214* (2013.01)

(58) Field of Classification Search
CPC ..... H01H 71/0214; H01H 71/2463
USPC ..... 335/21, 172–176
See application file for complete search history.

(56) References Cited

U.S. PATENT DOCUMENTS

| | | | | |
|---|---|---|---|---|
| 5,343,179 A * | 8/1994 | Pipich | H01H 71/2463 | 335/167 |
| 6,421,217 B1 * | 7/2002 | Castonguay | H01H 71/322 | 361/115 |
| 6,441,708 B1 * | 8/2002 | Rodriguez | H01H 83/20 | 335/14 |

* cited by examiner

*Primary Examiner* — Bernard Rojas

(57) ABSTRACT

A shunt trip device for a circuit breaker having a trip bar for tripping the circuit breaker. The device includes a housing having a slot and a bottom wall having a pivot pocket. The device also includes a lever arm having a lever projection portion and a pivot portion. The pivot portion is located in the pivot pocket to enable rotation of the lever arm in the slot about a lever rotation axis between first and second positions. When the lever arm is in the second position, the lever projection portion moves the trip bar and trips the circuit breaker. The device further includes an actuation device that moves the lever arm to the second position. The pivot portion and pivot pocket form a configuration that increases a perpendicular distance between a force generated by the actuation device and the lever rotation axis.

20 Claims, 5 Drawing Sheets

LEVER ARM FOR A SHUNT TRIP DEVICE

CROSS REFERENCE TO RELATED APPLICATION

This application claims the benefit under 35 U.S.C. §119 (e) of U.S. Provisional Application No. 61/918,251 entitled SHUNT TRIP KICKER QR-BREAKER INTERNAL ACCESSORY, filed on Dec. 19, 2013, which is incorporated herein by reference in its entirety and to which this application claims the benefit of priority.

FIELD OF THE INVENTION

The invention relates to shunt trip devices, and more particularly, to a shunt trip device having a housing that includes a bottom wall having a pivot pocket and a lever arm having a pivot portion to form a configuration that enables rotation of the lever arm about a lever rotation axis wherein the pivot portion and pivot pocket configuration increases a perpendicular distance between a force vector generated by an actuation device and the lever rotation axis to enable the use of a larger lever moment arm and thus a smaller actuation device.

BACKGROUND OF THE INVENTION

A circuit breaker is used to protect an electric circuit from damage caused by a persistent overcurrent condition, short circuit, fault or other anomaly. During normal operation, mating contacts located within the circuit breaker are kept in a closed position to enable current flow through the circuit. When a fault condition is detected, the contacts are automatically opened, thus interrupting the circuit and disengaging the circuit from a power supply (i.e., the circuit breaker is tripped). The circuit breaker may also be manually tripped by moving a breaker trip bar. Movement of the trip bar releases a trip mechanism that holds the contacts in the closed position, thus opening the contacts.

A circuit breaker may be used in conjunction with a circuit breaker accessory such as a shunt trip device. A shunt trip device enables remote tripping of a circuit breaker. For example, a shunt trip device enables emergency personnel arriving at a building fire to remotely trip a circuit breaker from a control panel in order to enhance personnel safety and protect equipment.

A shunt trip device includes a device housing that is relatively small and has limited internal space. The device housing holds a solenoid having a moveable plunger, a lever for moving the trip bar and other components. When the solenoid is energized, the plunger pushes on the lever and the lever then moves the trip bar and trips the circuit breaker. Frequently, the force/torque and displacement requirements for moving the trip bar are greater than the available force from the solenoid and/or greater than the leverage provided by the lever. In order to provide additional force/torque to move the trip bar, a larger solenoid having additional capacity may be used. However, a larger solenoid draws relatively large amounts of current which is not desirable to customers and would occupy additional space in the device housing.

Alternatively, a larger lever may be used in order to increase a force multiplier effect provided by the lever. However, a larger lever requires a large space in the device housing. Further, the lever rotates about a pin formed in the device housing as part of a pin-pivot arrangement. Referring to FIG. 1, a lower portion of an conventional lever 5 having hole 7 for receiving a pin is shown. In a pin-pivot arrangement, an area 9 around the pin in the device housing must be sufficiently large so to accommodate both a hole for the pin and a material web needed around the hole to support the pin. This further takes up the limited available space in the device housing. Moreover, the pin-pivot arrangement is prone to assembly errors, thus increasing manufacturing costs.

SUMMARY OF INVENTION

A shunt trip device is disclosed for a circuit breaker having a trip bar for tripping the circuit breaker. The device includes a housing having a slot and a bottom wall having a pivot pocket. The device also includes a lever arm having a lever projection portion and a pivot portion. The pivot portion is located in the pivot pocket to enable rotation of the lever arm in the slot about a lever rotation axis between first and second positions. When the lever arm is in the second position, the lever projection portion moves the trip bar and trips the circuit breaker. The device further includes an actuation device such as a solenoid for moving the lever arm to the second position. The pivot portion and pivot pocket form a configuration that increases a perpendicular distance between a force generated by the solenoid and the lever rotation axis to enable the use of a larger lever and thus a smaller solenoid.

The respective features of the present invention may be applied jointly or severally in any combination or sub-combination by those skilled in the art.

BRIEF DESCRIPTION OF DRAWINGS

The teachings of the present invention can be readily understood by considering the following detailed description in conjunction with the accompanying drawings, in which.

To facilitate understanding, identical reference numerals have been used, where possible, to designate identical elements that are common to the figures.

DETAILED DESCRIPTION

Figure 1:
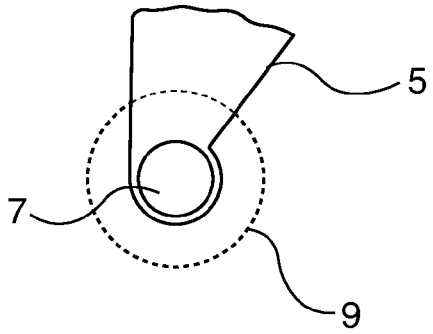
FIG. 1 depicts a lower portion of a conventional lever having hole for receiving a pin.

Although various embodiments that incorporate the teachings of the present invention have been shown and described in detail herein, those skilled in the art can readily devise many other varied embodiments that still incorporate these teachings. The invention is not limited in its application to the exemplary embodiment details of construction and the arrangement of components set forth in the description or illustrated in the drawings. The invention is capable of other embodiments and of being practiced or of being carried out in various ways. Also, it is to be understood that the phraseology and terminology used herein is for the purpose of description and should not be regarded as limiting. The use of "including," "comprising," or "having" and variations thereof herein is meant to encompass the items listed thereafter and equivalents thereof as well as additional items. Unless specified or limited otherwise, the terms "mounted," "connected," "supported," and "coupled" and variations thereof are used broadly and encompass direct and indirect mountings, connections, supports, and couplings. Further, "connected" and "coupled" are not restricted to physical or mechanical connections or couplings.

Figure 2:
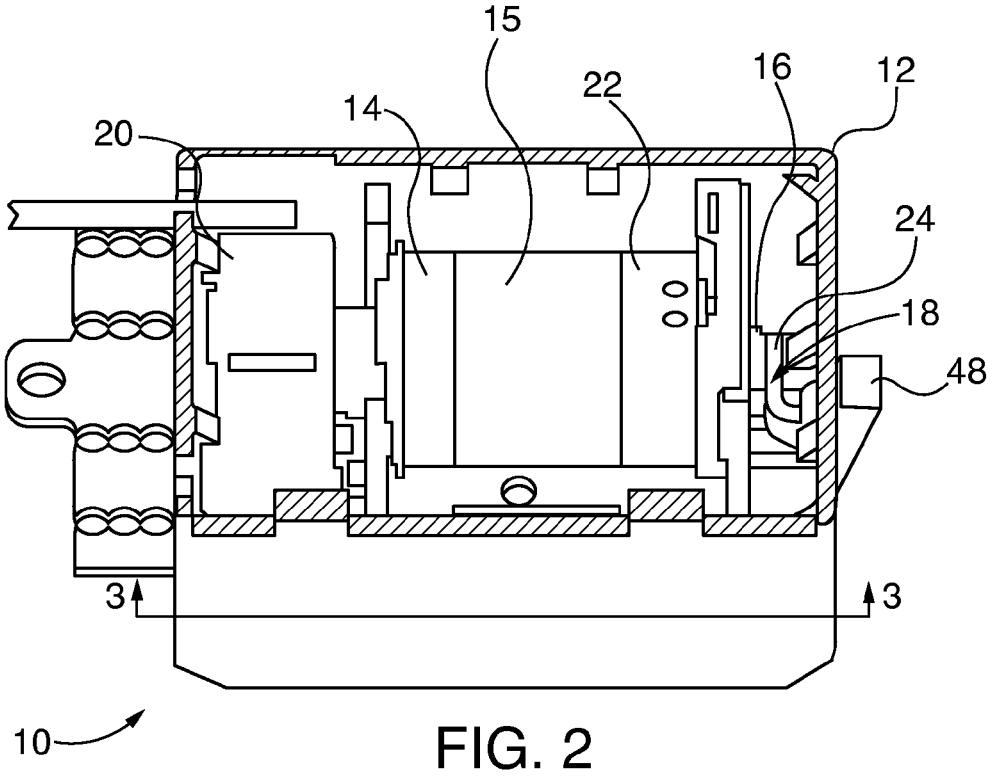
FIG. 2 is a top perspective view of a shunt trip device in accordance with the invention shown with a cover of the device removed.
Figure 3:
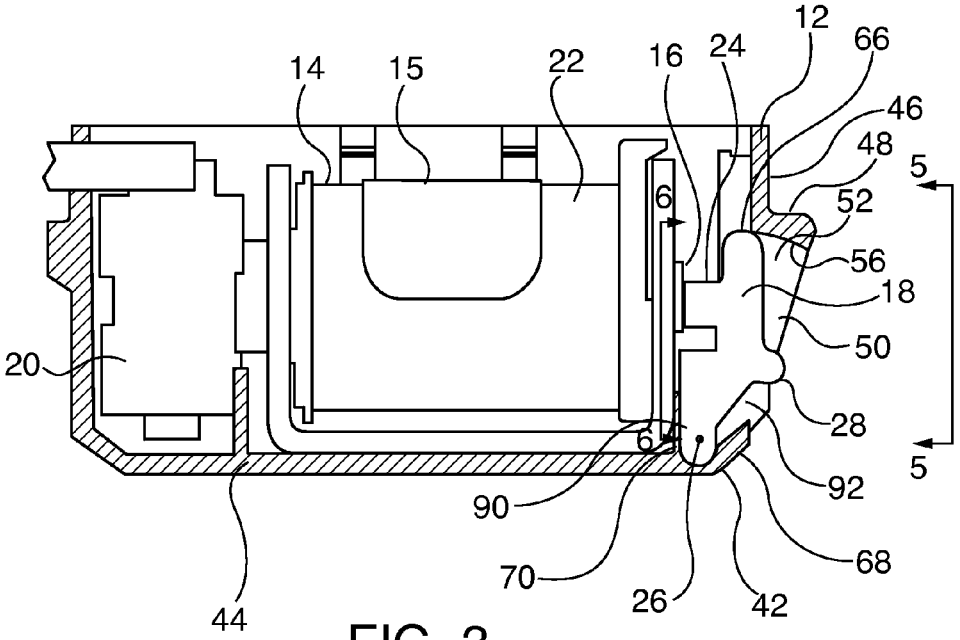
FIG. 3 is a side cross sectional view of the device along view line 3-3 of FIG. 2.

Referring to FIG. 2, a top perspective view of a shunt trip device 10 is shown with a cover of the device 10 removed. FIG. 3 is a side cross sectional view of the device 10 along view line 3-3 of FIG. 2. Referring to FIG. 2 in conjunction with FIG. 3, the device 10 includes an accessory housing 12 that holds an actuation device 15 such as a solenoid 14 having a moveable plunger 16, a rotatable shunt trip lever arm 18 and a cutoff switch 20. When the solenoid 14 is activated, the plunger 16 extends from a solenoid body 22 and pushes on an extension portion 24 of the lever 18. This causes the lever arm 18 to rotate about a lever rotation axis 26 such that a lever projection portion 28 of the lever arm 18 contacts a trip bar 87 (see FIG. 9) of a circuit breaker 72 in order to trip the circuit breaker 32 as will be described. The cutoff switch 20 serves to deactivate the solenoid 14 once the circuit breaker 32 is tripped. It is understood that other actuation devices may be used instead of the solenoid 14. For example, the actuation device 15 may be a magnetic latch (i.e. maglatch) device that includes a coil that generates a magnetic field wherein the magnetic field is used to move the lever arm 18 rather than the plunger 16.

Figure 4:
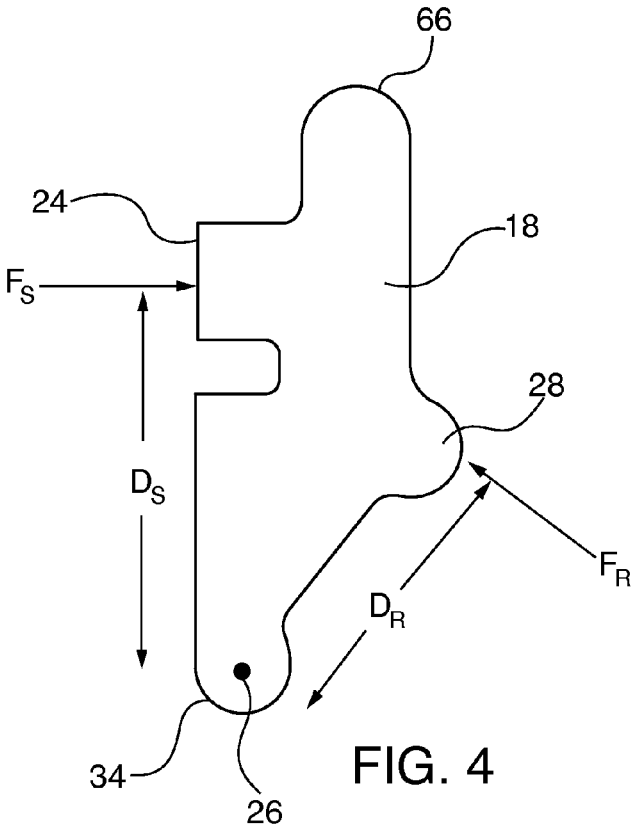
FIG. 4 is a side view of the lever arm of the current invention.

Referring to FIG. 4, a side view of the lever arm 18 of the current invention is shown. The lever arm 16 includes the extension portion 24 that is contacted by the solenoid plunger 16 as previously described. The lever arm 18 also includes a bottom pivot portion 34 having a rounded shape and the lever rotation axis 26. The lever arm 18 serves as a force multiplier for overcoming a resistance force of a trip bar. A relationship between the force generated by the solenoid 14 and the trip bar resistance force is given by the following expressions:

$$F_S \times D_S = F_R \times D_R \quad (1)$$

$$D_S > D_R \quad (2)$$

$$F_S < F_R \quad (3)$$

where $F_S$ is the force generated by the solenoid 14, $F_R$ is the trip bar resistance force (i.e. force required to move the trip bar), $D_S$ is the perpendicular distance between $F_S$ and the lever rotation axis 26 and $D_R$ is the perpendicular distance between $F_R$ and the lever rotation axis 26.

The device 10 is configured to fit into an accessory pocket 80 or 82 (see FIG. 7) formed in a circuit breaker housing 76. In many cases, an available volume within the accessory pocket 80 or 82 is limited, thus constraining the size of the accessory housing 12. This also constrains parameter $D_S$ to a smaller value than a desired value suitable for maintaining a balance between parameters $F_S$, $D_S$ and $D_R$.

Referring back to FIG. 3, the accessory housing 12 includes a pivot pocket 42 that is formed in a bottom wall 44 of the accessory housing 12. The pivot pocket 42 has a rounded shape for receiving the pivot portion 34. The pivot portion 34 is rotatable in the pivot pocket 42 about the lever rotation axis 26. In accordance with the invention, the lever rotation axis 26 is lower in the accessory housing 12 as compared to a rotation axis in a pin-pivot arrangement, thus increasing $D_S$ within the limited space available in the accessory housing 12. In use, the pivot portion 34 rotates in the pivot pocket 42 to enable clockwise and counterclockwise rotation of the lever arm 18 about the lever rotation axis 26.

Therefore, the current invention increases $D_S$ in the limited available space within the accessory housing 12. This reduces the magnitude of the force $F_S$ that the solenoid 14 needs to generate in order to move the trip bar 87. As a result, a smaller solenoid may be used thus reducing manufacturing costs. In addition, a smaller solenoid has lower supply line power requirements, and having lower supply line power requirements is desirable for customers.

Figure 5:
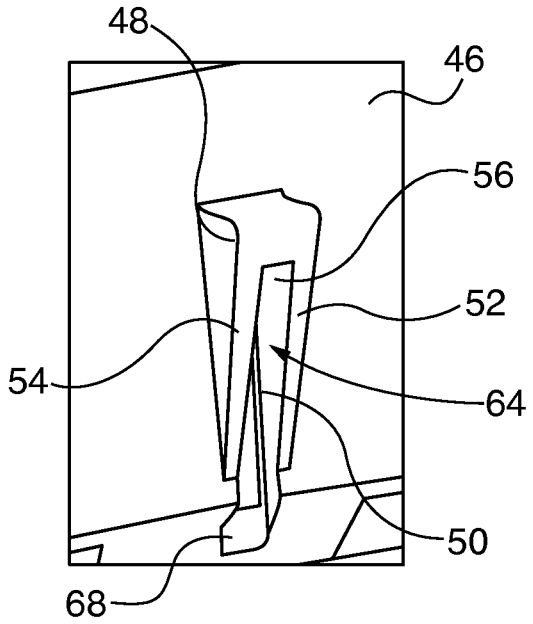
FIG. 5 is a view of an accessory housing along view line 5-5 of FIG. 3.
Figure 6:
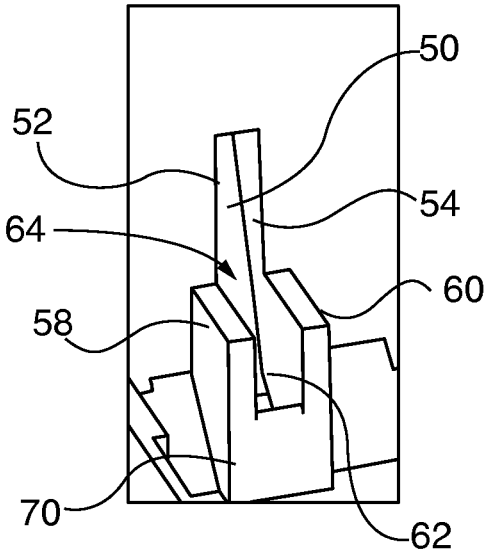
FIG. 6 is a view of the accessory housing along view line 6-6 of FIG. 3.

FIGS. 5 and 6 depict views of the accessory housing 12 without lever arm 18 along view lines 5-5 and 6-6, respectively, of FIG. 3. Referring to FIG. 3 in conjunction with FIG. 5, a front wall 46 of the accessory housing 12 includes a wall projection 48 that extends outwardly from the front wall 46. A housing slot 50 is formed through the wall projection 48 and the front wall 46. The housing slot 50 defines first 52 and second 54 housing sidewalls and a top wall 56. Referring to FIGS. 3 and 6, an interior of the accessory housing 12 includes spaced apart first 58 and second 60 interior walls, respectively, which form a slot 62 that is aligned with the housing slot 50 thereby forming a continuous slot 64 that is sized to accommodate the lever arm 18. The first 52 and second 54 housing sidewalk and the first 58 and second 60 interior walls guide rotational movement of the lever arm 18 within the slot 64. The top wall 56 has a curved surface whose shape corresponds to the sweep circumference of the top portion 66 of the lever arm 18. The top wall 56 is spaced apart from the pivot pocket 42 to accommodate a size of the lever arm 18 as the lever arm 18 rotates about the lever rotation axis 26. The pivot pocket 42, slot 64, and the top wall 56 at least partially encapsulate the lever arm 18 and guide the lever arm 18 during clockwise and counterclockwise rotation. Therefore, once the lever arm 18 is positioned in the pivot pocket 42 and the solenoid 14 is installed, the lever arm 18 is fully retained within the accessory housing 12 without the need of fasteners or other hardware.

The accessory housing 12 further includes front 68 and rear 70 retention walls. The rear retention wall 70 is oriented in a vertical direction and is located between the lever arm 18 and the solenoid 14. The front retention wall 68 is angled and is unistructurally formed with front wall 46 to form a one-piece configuration. Alternatively, the front retention wall 68 may be separately formed from the front wall 46. The front 68 and rear 70 retention walls close off front and rear portions of the slot 64 and serve to limit rotation of the lever arm 18 in the slot 64.

Figure 7:
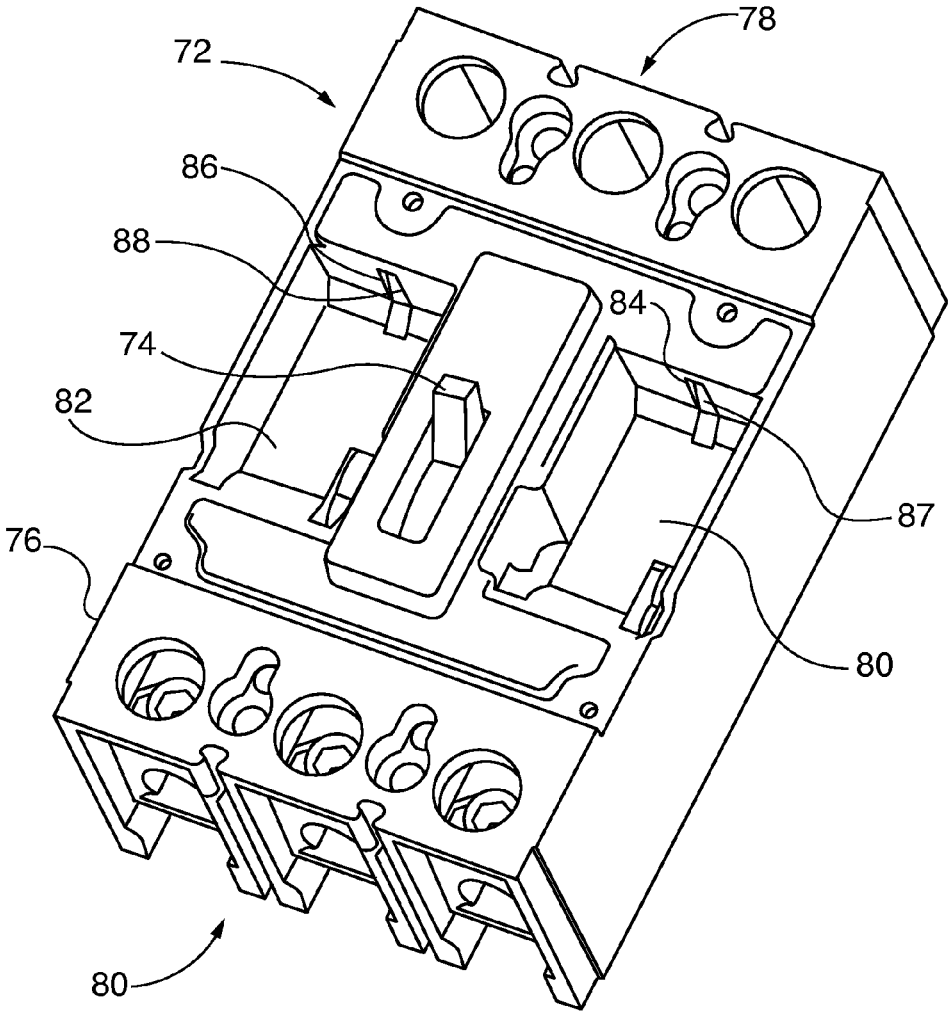
FIG. 7 is a perspective view of an exemplary three phase circuit breaker.

Referring to FIG. 7, a perspective view of an exemplary three phase circuit breaker 72 is shown. The circuit breaker 72 includes a handle 74 that extends from a circuit breaker housing 76 molded from an insulating material. The handle 74 is moveable between on, off and tripped positions to enable a trip mechanism located in the housing 76 to engage and disengage a moveable contact and a stationary contact for each of the three phases in a known manner, such that a line terminal 78 and load terminal 80 of each phase are electrically connected.

The circuit breaker 72 further includes first 80 and second 82 accessory pockets. The device 10 is configured to fit into either the first 80 and second 82 accessory pocket. As previously described, the available volume in either the first 80 or second 82 accessory pocket is limited, thus constraining the size of the accessory housing 12. The first 80 and second 82 accessory pockets include first 84 and second 86 apertures that provide to access to first 87 and second 88 trip bars, respectively. The circuit breaker 72 may also be manually tripped by moving either the first 87 or second 88 trip bar.

Movement of either the first 87 or second 88 trip bar releases a trip mechanism that holds the contacts in the closed position, thus opening the contacts.

Figure 8:
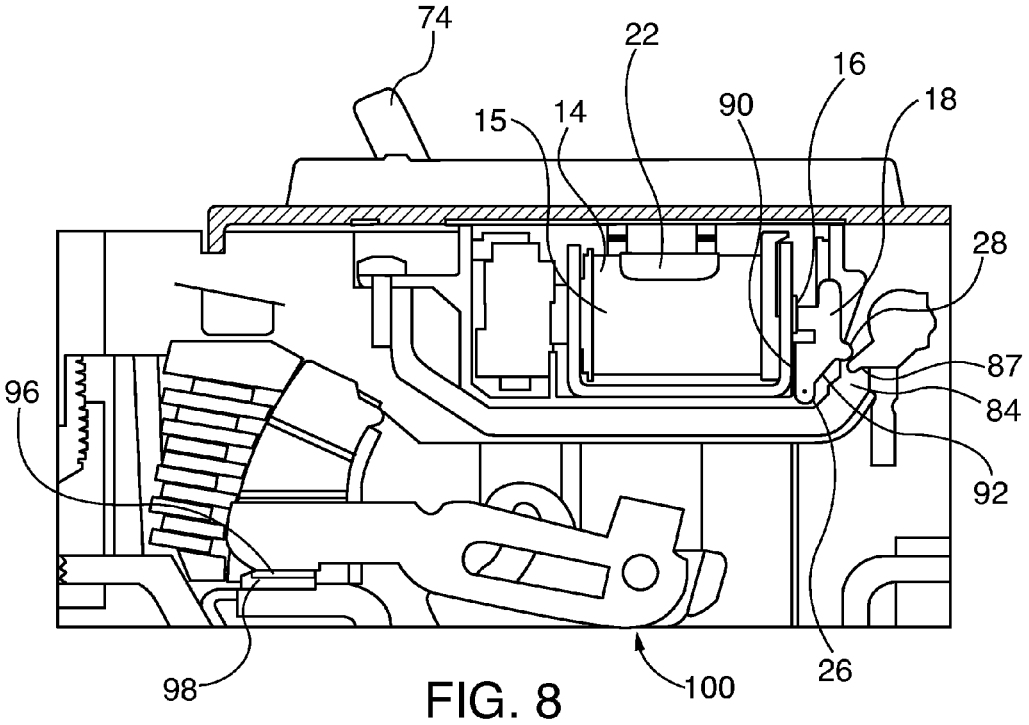
FIG. 8 depicts the lever arm in a first position.
Figure 9:
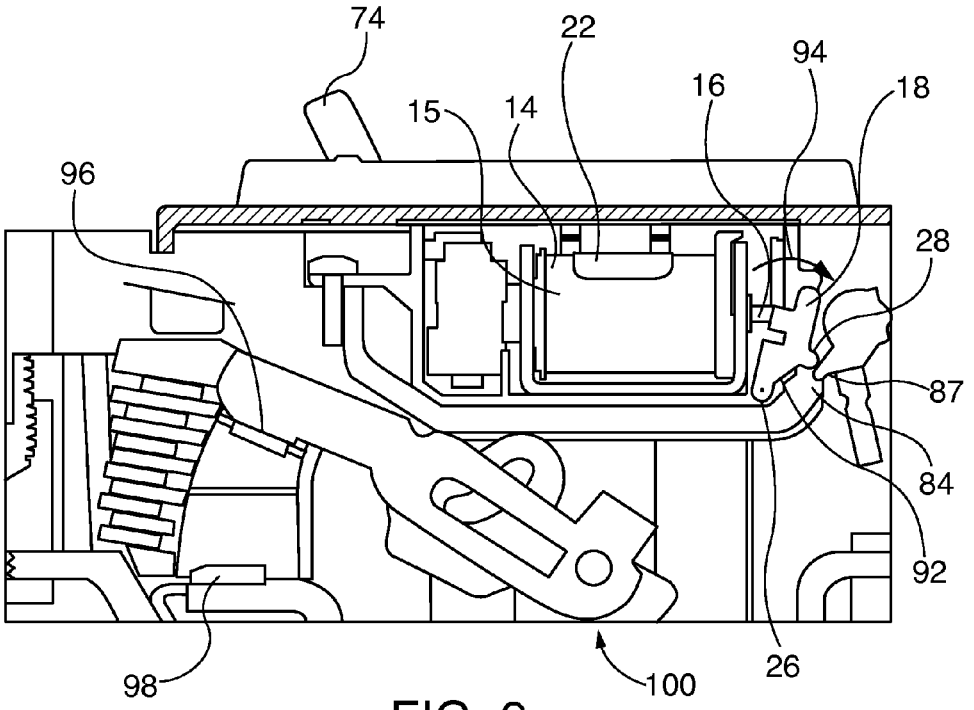
FIG. 9 depicts the lever arm a second position.

FIGS. 8 and 9 depict the lever arm 18 in first and second positions, respectively. For illustrative purposes, the device 10 is shown positioned in the first accessory pocket 80. Referring to FIG. 8 and FIG. 3, the lever arm 18 is oriented substantially vertically in the first position wherein a rear vertical portion 90 of the lever arm 18 abuts against the rear retention wall 70, thus stopping counterclockwise rotation of the lever arm 18. In this position, a moveable contact 96 and a stationary contact 98 located in the circuit breaker 72 are in contact with each other. Referring to FIG. 9, the second position for lever arm 18 is shown. In the second position, a front angled portion 92 of the lever arm 18 abuts against the front retention wall 68 (shown in FIG. 3), thus stopping clockwise rotation 94 of the lever arm 18. In the second position, the lever projection portion 28 extends through the first aperture 84 in the first accessory pocket 80 and contacts the first trip bar 87 thus moving the first trip bar 87. This releases a trip mechanism 100 and causes the moveable contact 96 to separate from the stationary contact 98 to thus trip the circuit breaker 72.

The current invention eliminates the need of a pin thus increasing an amount of available space in the accessory housing 12 to enable the use of a longer lever, thus avoiding the use of a larger solenoid. Further, the current invention simplifies assembly of the device thus reducing product cost.

While particular embodiments of the present invention have been illustrated and described, it would be obvious to those skilled in the art that various other changes and modifications can be made without departing from the spirit and scope of the invention. It is therefore intended to cover in the appended claims all such changes and modifications that are within the scope of this invention.

What is claimed is:

1. A shunt trip device for a circuit breaker having a trip bar for tripping the circuit breaker, comprising:

a housing having a bottom wall and a front wall;

a pivot pocket formed in the bottom wall;

a lever arm having a lever projection portion and a pivot portion, wherein the pivot portion is located in the pivot pocket to enable rotation of the lever arm about a lever rotation axis between first and second positions wherein when the lever arm is in the second position the lever projection portion moves the trip bar and trips the circuit breaker;

an actuation device for moving the lever arm to the second position; and front and rear retention walls for stopping rotation of the lever arm in the second and first positions, respectively, wherein the rear retention wall is located between a solenoid and the lever arm.

2. The device according to claim 1, wherein the housing includes a slot and the lever arm rotates within the slot.

3. The device according to claim 1, wherein the actuation device is a solenoid having a plunger.

4. The device according to claim 3, wherein the lever arm includes an extension portion that is contacted by the plunger.

5. The device according to claim 1, wherein the front wall includes the front retention wall.

6. A shunt trip device for a circuit breaker having a trip bar for tripping the circuit breaker, comprising:

a housing having a bottom wall, a front wall, spaced apart interior walls and a slot that extends through the front wall and between the spaced apart interior walls;

a pivot pocket formed in the bottom wall;

a lever arm having a lever projection portion and a pivot portion, wherein the lever arm is located in the slot and the pivot portion is located in the pivot pocket to enable rotation of the lever arm about a lever rotation axis between first and second positions wherein when the lever arm is in the second position the lever projection portion moves the trip bar and trips the circuit breaker; and an actuation device for moving the lever arm to the second position.

7. The device according to claim 6 wherein the pivot pocket, slot and top wall guide the lever arm during rotation between the first and second positions.

8. The device according to claim 6, wherein the pivot pocket and the pivot portion each have a rounded shape.

9. The device according to claim 6, wherein the actuation device is a solenoid having a plunger.

10. The device according to claim 9, wherein the lever arm includes an extension portion that is contacted by the plunger.

11. The device according to claim 6 further including front and rear retention walls for stopping rotation of the lever arm in the second and first positions, respectively.

12. The device according to claim 11, wherein the rear retention wall is located between the solenoid and the lever arm.

13. The device according to claim 11, wherein the front wall includes the front retention wall.

14. A method for moving a trip bar of a circuit breaker to trip the circuit breaker, comprising:

providing a pivot pocket formed in a bottom wall of a housing;

providing a lever arm having a lever projection portion and a pivot portion, wherein the pivot portion is located in the pivot pocket;

rotating the lever arm about a lever rotation axis from a first position to a second position wherein when the lever arm is in the second position the lever projection portion moves the trip bar and trips the circuit breaker; and providing front and rear retention walls for stopping rotation of the lever arm in the second and first positions, respectively, wherein the rear retention wall is located between a solenoid and the lever arm.

15. The method according to claim 14, further including providing an actuation device for moving the lever arm to the second position.

16. The method according to claim 15, wherein the actuation device is a solenoid having a moveable plunger.

17. The method according to claim 14, further including providing a slot wherein the lever arm rotates in the slot.

18. The device according to claim 17, wherein the slot forms a top wall in the housing and wherein the pivot pocket, slot and top wall guide the lever arm during rotation between the first and second positions.

19. The method according to claim 14, wherein the front retention wall is formed in a front wall of the housing.

20. The method according to claim 16, wherein the lever arm includes an extension portion that is contacted by the solenoid plunger.

* * * * *